US005908264A

United States Patent [19]

Hey

[11] Patent Number: 5,908,264

[45] Date of Patent: Jun. 1, 1999

[54] WATERCRAFT LIFT

[76] Inventor: Kenneth E. Hey, 10932 Rainier Ave. S., Seattle, Wash. 98178

[21] Appl. No.: 08/903,578

[22] Filed: Jul. 31, 1997

[51] Int. Cl.[6] ..... B63C 3/06

[52] U.S. Cl. ..... 405/3; 114/44

[58] Field of Search ..... 405/3, 4, 7, 1; 114/44, 45, 48

[56] References Cited

U.S. PATENT DOCUMENTS

| | | | |
|---|---|---|---|
| 728,117 | 5/1903 | Kirsch et al. . | |
| 1,106,930 | 8/1914 | Desmond . | |
| 1,503,369 | 7/1924 | Lavoie . | |
| 2,505,832 | 5/1950 | Lange . | |
| 2,598,271 | 5/1952 | Klosterman . | |
| 2,613,915 | 10/1952 | Stone . | |
| 2,840,346 | 6/1958 | Moulin . | |
| 2,896,583 | 7/1959 | Stixrood . | |
| 2,963,176 | 12/1960 | Smith . | |
| 3,021,965 | 2/1962 | Harvey . | |
| 3,033,626 | 5/1962 | Corley . | |
| 3,062,601 | 11/1962 | Sadler et al. . | |
| 3,319,537 | 5/1967 | Pittman . | |
| 3,753,355 | 8/1973 | Knoch . | |
| 3,863,890 | 2/1975 | Ruffing . | |
| 4,022,027 | 5/1977 | Tetzner . | |
| 4,027,492 | 6/1977 | Carpenter . | |
| 4,087,076 | 5/1978 | Getty . | |
| 4,121,840 | 10/1978 | Berg . | |
| 4,149,469 | 4/1979 | Bigler | 405/3 |
| 4,211,151 | 7/1980 | Wallischeck . | |
| 4,286,800 | 9/1981 | Lomas . | |
| 4,300,439 | 11/1981 | Degnan et al. . | |
| 4,432,664 | 2/1984 | Baldyga . | |
| 4,641,996 | 2/1987 | Seal . | |
| 4,895,479 | 1/1990 | Michaelsen et al. . | |
| 5,007,121 | 4/1991 | McEathron . | |
| 5,184,914 | 2/1993 | Basta . | |
| 5,275,505 | 1/1994 | Wilcox | 405/3 |

*Primary Examiner*—Tamara Graysay
*Assistant Examiner*—Frederick L. Lagman
*Attorney, Agent, or Firm*—Christensen O'Connor Johnson & Kindness PLLC

[57] ABSTRACT

A watercraft lift having raised and lowered positions is provided. The lift includes a substantially rectangular base (10) with longitudinal side beams (34) and front, rear, and intermediate transverse beams (28), (30), (32) connected to the longitudinal beams. The intermediate transverse beam (32) is located between the front and rear transverse beams (28), (30) and at a height lower than the front and rear transverse beams. Forward booms (12) are pivotably connected to the base (10) at a location near the front transverse beam (28). Rear booms (14) are pivotably connected to the base at a location near the intermediate transverse beam (32). A watercraft support platform (24) is pivotally connected to the forward and rear booms (12), (14). The raising and lowering of the lift of the present invention is accomplished by an actuation assembly (26). In a preferred embodiments, the actuation assembly includes two dual-directional high pressure hydraulic cylinders (62) pivotally connected between the intermediate transverse beam (32) and the rear booms (14). During use, the actuator assembly (26) rotates the booms (12), (14) upward and forward about their pivotable connection to the base (10) further raising the watercraft support platform and the watercraft to an over-center position.

31 Claims, 5 Drawing Sheets

WATERCRAFT LIFT

FIELD OF THE INVENTION

The present invention relates to lifts for watercraft, such as boats and seaplanes, and more particularly, to lifts for raising and lowering a watercraft from the water for storage.

BACKGROUND OF THE INVENTION

There are a number of advantages to storing a boat out of the water when it is not in use. Out-of-water storage prevents damage resulting from the boat bumping against adjacent docks, other crafts, or floating debris. It reduces the possibility of the boat breaking free from its moorage and either floating away or running aground. Out-of-water storage also lessens boat damage associated with long-term exposure to water and water-carried pollutants (e.g., corrosion, electrolysis, rusting, etc.), and the attachment of barnacles or other marine growth to the boat's hull. To store a craft out of water, many boat owners prefer to use a boat lift that simply raises the craft above the water's surface as opposed to the more involved procedure of dry docking the craft. Once a boat is lifted it can be maintained in a raised position for an extended period of time. A number of lift designs are currently known that provide this basic function.

U.S. Pat. No. 4,895,479 describes a lift for a watercraft that includes a base frame positioned underwater. The frame supports upwardly extending pivotable parallel arms. A lift platform is connect to the upper ends of the arms. The base frame, arms, and platform combine to form a parallelogram shape when viewed from the side. The lift is actuated by a hydraulic cylinder that is connected diagonally across the parallelogram. Extension of the cylinder rotates the arms about their lower end connection to the base frame. Thus, the rotation of the arms moves the lift platform (and hence any watercraft thereon) between raised and lowered positions. In its raised position, the pivotable arms are disposed under true vertical at an angle of approximately 70° counterclockwise from horizontal. The pivotable arms are locked in this position by a cylinder locking mechanism that includes a pawl having a nose that is insertable into slots spaced along the cylinder's plunger. The nose is biased to enter a slot by a compression spring.

Another known boat lift is described in U.S. Pat. No. 5,184,914. The '914 lift has upwardly extending pivoting booms that are supported on a rectangular base submerged in water, similar to the '479 device. A watercraft support platform is connected to the upper ends of the pivoting booms. A double-acting hydraulic cylinder is connected diagonally between the rectangular base and the forward pivoting booms. The cylinder swings the pivoting booms upwardly until the booms are braced by boom stops located on the base. In the lift's fully extended position, the booms are braced against the boom stops at an angle of about 10° overcenter (i.e., 10° counterclockwise past vertical). Like the '479 lift, the '914 lift has a parallelogram configuration in side view.

Both the '479 and '914 devices suffer from a number of disadvantages. For example, the locking mechanism of the '479 device can be unreliable and hazardous, resulting in the unexpected and rapid lowering of a watercraft should the pawl release the plunger or otherwise fail. It appears that the '914 device attempts to overcome the deficiencies of the '479 cylinder locking mechanism by instead using the canted boom stops to brace the pivoting booms in an overcenter position.

A second disadvantage is that the diagonal placement of the actuating components in the '479 and '914 devices limit the minimum lowered position height that may be attained. It is desirable for a lift to be capable of being moved to a low height, to enable a user to drive a boat onto the lift in shallower waters. This does not appear to be possible with the '479 and '914 lifts, since both devices are configured with their actuators oriented between the middle of a rear transverse beam and the middle of a cross member at the forward boom arms. For the cylinders to effectively raise the arms, the force exerted by the cylinders must include a significant vertical force component at all times. This is especially true when the lift is in its lowered position, otherwise the cylinder will not be able to raise the arms, but will instead jam against the connection to the forward booms when the cylinder attempts to extend. It is this required vertical component that prohibits the lift from lowering further. The '914 lift has an additional disadvantage in that its canted boom stops further limits the minimum lowered height attainable.

A third disadvantage is that both devices appear to be using low pressure hydraulic water cylinders. These large cylinders are typically not sealed well enough to maintain the lift in any particular position. The '479 lift compensates for this insufficiency by including a cylinder locking mechanism. The '914 lift compensates by positioning the support platform overcenter, braced against the canted boom stops.

A fourth disadvantage of the '479 and '914 devices is the mid-lateral placement of their hydraulic cylinders. At this location, the cylinders can interfere with the keels and skegs of certain watercraft, thereby limiting and restricting the lift's utility to shallow keeled and shallow skegged crafts.

Accordingly, there exists a need for a watercraft lift that can safely, securely, and reliably support a watercraft in a lowered position, a raised position, and all points in between. The ideal watercraft lift should be operable in relatively shallow water, and should accormodate watercraft having deeper keels and skegs. The lift's minimum height should not be limited by the actuating components, so that the lift can be used in shallower waters. The present invention is directed to fulfilling this need and to providing further related advantages.

SUMMARY OF THE INVENTION

In accordance with the present invention, a watercraft lift is provided that pivots between raised and lowered positions. The lift includes a substantially rectangular base with longitudinal side beams and front, rear, and intermediate transverse beams connected to the longitudinal beams. The intermediate transverse beam is located between the front and rear transverse beams and at a height lower than the front and rear transverse beams. Forward booms are pivotably connected to the base at a location near the front transverse beam. Rear booms are pivotably connected to the base at a location near the intermediate transverse beam. A watercraft support platform is pivotally connected to the forward and rear booms.

The raising and lowering of the lift of the present invention is accomplished by an actuation assembly. In a preferred embodiments, the actuation assembly includes two dual-directional high pressure hydraulic cylinders pivotally connected between the intermediate transverse beam and the rear booms. During use, the actuator assembly rotates the booms upward and forward about their pivotable connection to the base further raising the watercraft support platform and the watercraft to an overcenter position. The actuation assembly includes one or more dual-directional hydraulic cylinders. Preferred embodiments includes two high pressure hydraulic cylinder that use a water soluble hydraulic cylinder operating at a pressure in the range of about 1000 psi to about 3000 psi. In an alternative embodiment, the actuation assembly includes one or more low pressure water cylinders, preferably operating at a pressure in the range of about 40 psi to about 125 psi.

In accordance with other aspects of this invention, the lift's fully raised position is in the range of about 1° to about 12° over center from vertical. Preferred embodiments are formed with the forward booms being a longer length than the rear booms such that the platform is tilted downward in the aft direction, the angle of tilt lessening in going from the lowered lift position to the raised lift position.

In accordance with further aspects of this invention, an independent power supply unit is provided including a sealed housing, a battery, a motor, a pump, a reservoir, and a control unit. The battery, motor, pump, a reservoir, and control unit are positioned within the sealed housing and are capable of activating the actuation assembly. The power supply unit further includes a solar panel connected to the battery and located within the sealed housing. An optional remote control transmitting device is in communication with the control unit to activate the control unit and the lift actuation assembly without the operator having to physically go from the boat to the dock. Optional underwater lights may be activated by the remote control device.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
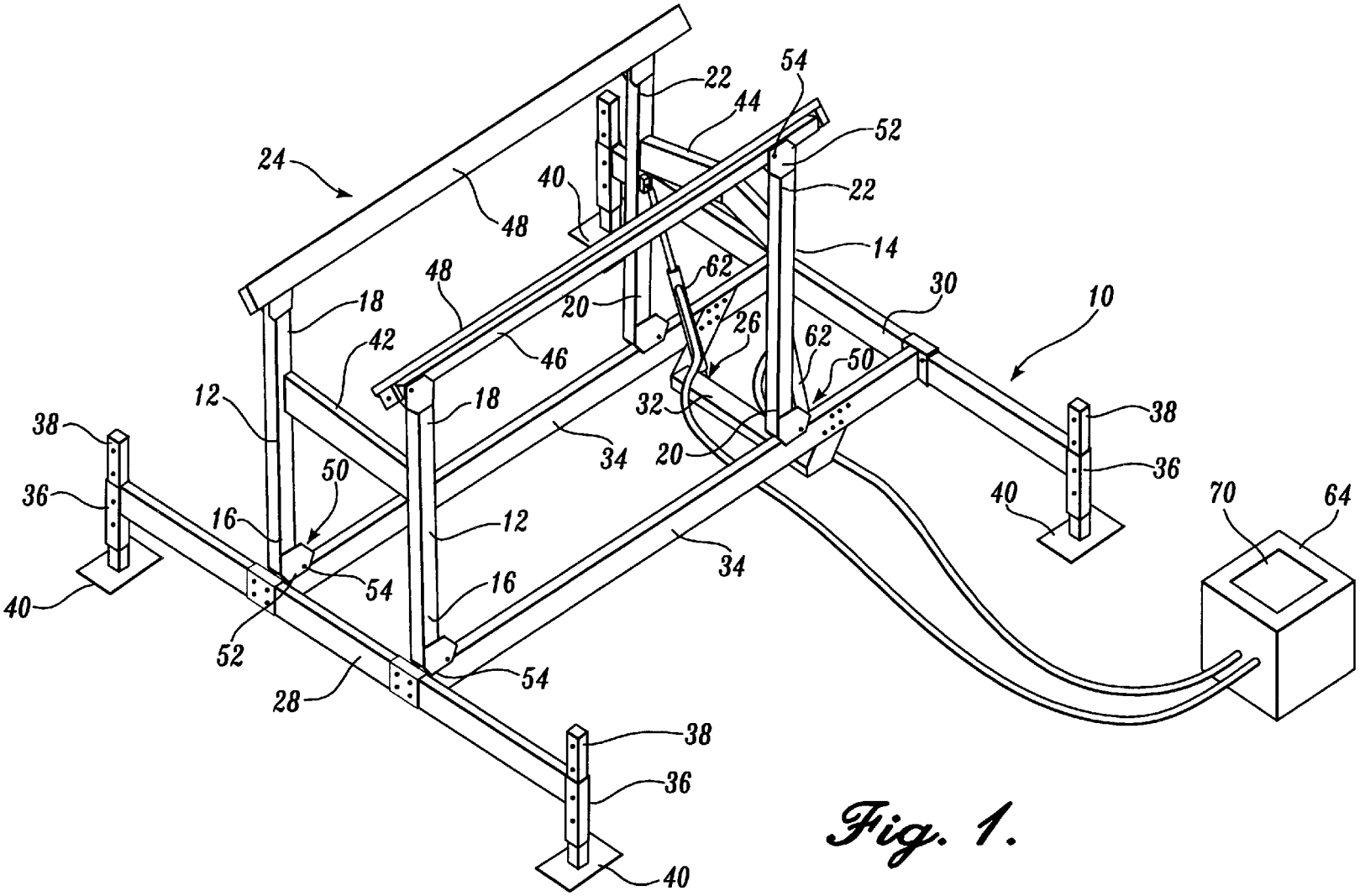
FIG. 1 is a perspective view of one embodiment of a watercraft lift formed in accordance with the present invention.

As shown in FIG. 1, a watercraft lift formed in accordance with the present invention generally includes a rectangular base 10 and forward and rear pairs of pivoting booms 12, 14 with proximal and distal ends 16, 18 and 20, 22, respectively. The booms 12, 14 are rotatably attached at their proximal ends 16, 20 to the base 10 and rotatably attached at their distal ends 18, 22 to a watercraft support platform 24. The support platform 24 is arranged to receive and support a watercraft (not shown). The lift further includes an actuation assembly 26 for pivoting the booms 12, 14 about their proximal end connections to the base. This action causes the booms, and hence the support platform and watercraft, to move between raised and lowered positions.

In more detail, referring to FIG. 1, the base 10 includes a front transverse beam 28, a rear transverse beam 30, and an intermediate transverse beam 32 located therebetween. The transverse beams 28, 30, 32 are positioned parallel to one another and are connected to parallel longitudinal side beams 34. The front and rear transverse beams 28, 30 are horizontally oriented at one height, while the intermediate transverse beam 32 is horizontally oriented at a second, lower, height. (See FIG. 2.) The ends of the front and rear transverse beams extend laterally outboard of the longitudinal side beams 34 and include upright sleeves 36. The sleeves 36 receive support posts 38 that include lower end shoes 40 capable of resting on a lake or river bottom. The posts 38 and sleeves 40 cooperate to enable an operator to adjust the base to a desired height. The base members are preferably formed from strong, lightweight, corrosion-resistant materials, e.g., tubular ¼-inch wall marine grade aluminum. A lightweight design is desirable for easier installation and removal, especially in regions where freezing weather requires that the lift be removed annually. The base arrangement of FIG. 1 has the advantage of also allowing a user to easily attach a conventional canopy structure to the lift by inserting upright mating canopy poles (not shown) into the posts.

Figure 3:
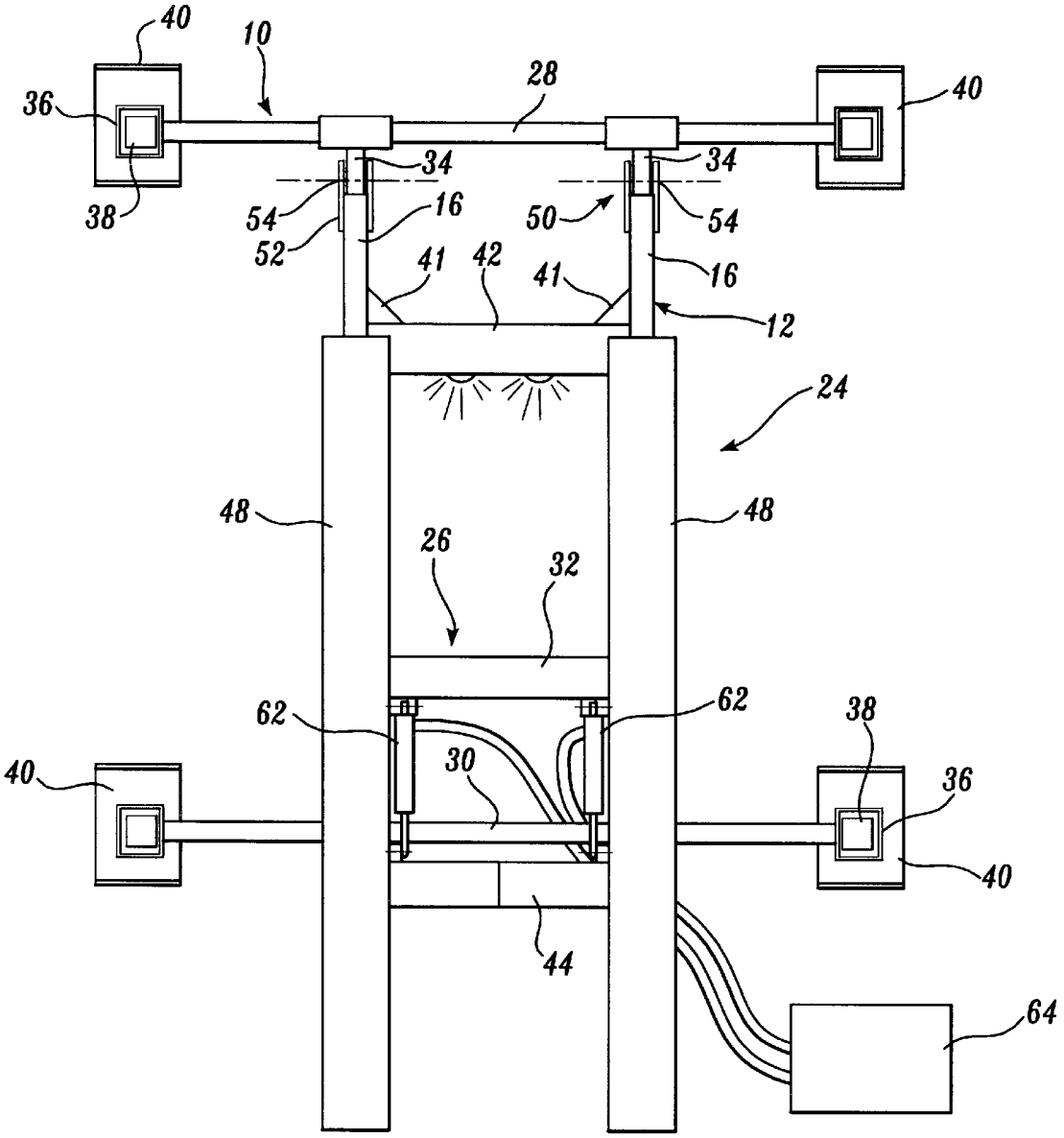
FIG. 3 is a planform view of an alternative embodiment of a watercraft lift formed in accordance with the present invention.

Still referring to FIG. 1, the forward booms 12 and the rear booms 14 are each pivotably connected to the longitudinal side beams 34 near the front and intermediate transverse beams 28, 32, respectively. The rear booms 14 are located slightly forward of the intermediate transverse beam 32. By positioning the rear transverse beam 30 aft of the connection of the rear booms 14 with the longitudinal side beams 34, the lift can accommodate variations in the placement of the boat's center of gravity. Various gussets may be used to strengthen the connection of the beams. Side load gussets 41 are shown in FIG. 3. Forward and rear cross supports 42, 44 provide structural rigidity between the forward and rear pairs of booms 12, 14. As shown best in FIGS. 1 and 4, the rear cross support 44 is V-shaped to offer hull clearance when the lift is in its lowered position and to continue to clear the hull of a V-shaped watercraft when the lift is in a raised position. This enables the present invention lift to be positioned in very shallow water, since a boat will not conflict with the rear cross support as the boat enters the watercraft support platform.

Figure 2:
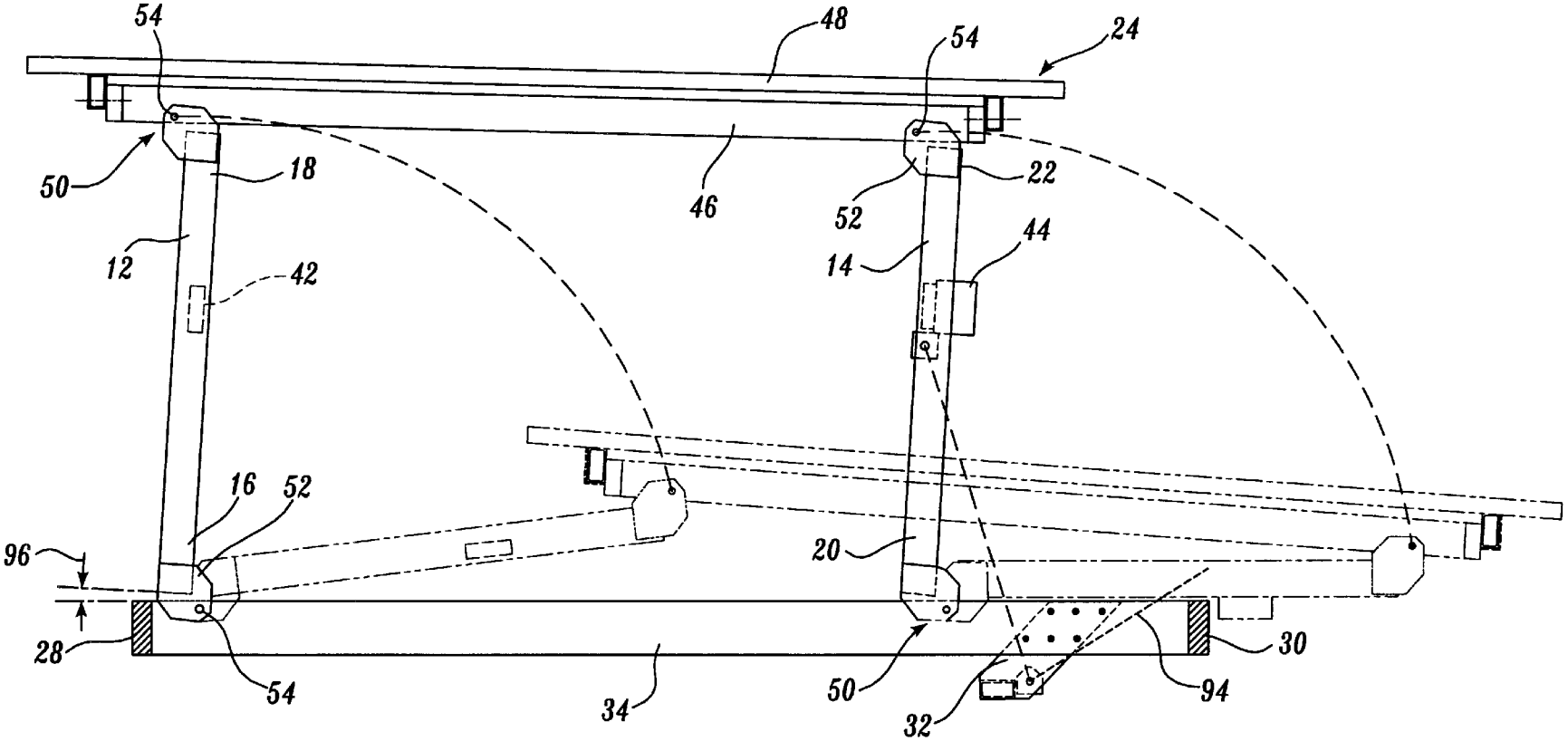
FIG. 2 is a side view of the watercraft lift of FIG. 1, showing the lift in a raised position, phantom lines indicating the lift in a lowered position.

In preferred embodiments, the forward booms 12 are slightly longer than the rear booms 14. When the lift is in a fully raised position, the combination of the forward and rear booms 12, 14 with the longitudinal side beams 34 and watercraft support platform 24 forms a trapezoidal shape in side view (i.e., the booms being the parallel sides). This requires the distance between the boom distal end connections to be slightly shorter than the distance between the boom proximal end connections. Referring to FIG. 2, these relative measurements give the watercraft support platform a slight downward angle in the rearward direction when the lift is in the raised position, and a more significant downward angle in the lowered position. In the embodiment shown in FIG. 2, the vertical difference between the front and back ends of the support platform is about 9 inches when the lift is in the lowered position, and about 2 inches when the lift is in the raised position.

It is advantageous to use such an arrangement since it keeps the boat nearly horizontal while in the raised position which is good for water drainage and visual appearance, while providing an increased slope in the lowered position to assist the user in driving the boat on to and off of the platform. In alternative embodiments, the booms 12, 14 and pivot connection distances may be the same length, with the watercraft support platform 24 being modified to slope in the rearward direction. Either arrangement makes it easier for the user to drive a boat onto and off of the platform. The former arrangement, however, additionally provides the advantage of reducing the loads on the actuation assembly, since the angle of the forward boom with the longitudinal side beams is not as shallow as the angle of the rear boom with the longitudinal side beams when the lift is at the lowered position.

Referring back to FIG. 1, the watercraft support platform 24 includes a pair of bunk beams 46 oriented parallel to the longitudinal side beams 34 and within the general upright plane of the forward and rear booms. The bunk beams 46 are separated by a distance sufficient to safely cradle the hull of the boat. A pair of cushioned bunks 48 are attached to the upper surfaces of the bunk beams and are canted toward each other. In one embodiment of a watercraft support platform, only the bunks ends are attached to the bunk beams. When the boat is loaded onto the platform, the center of each bunk 48 defects a small amount (e.g., ~1-inch) downward before contacting its supporting bunk beam 46. Therefore, the bunk acts as a type of leaf spring. Other types of watercraft support platforms may be used to accommodate the multitude of watercraft variations in the size and shape.

The boom distal ends 18, 22 are pivotally joined to the bunk beams using offset pivot joints 50. Referring to FIG. 2, the boom distal ends include a structural portion that is laterally offset forward from the longitudinal centerline of the boom. In this embodiment, the offset portion is formed from a pair of plates 52 welded to each boom distal end. The plates straddle the bunk beams 46 and are pivotably held to the beam by rotatable pins 54. The pins 54 are preferably about ¾-inches in diameter and are formed from all stainless steel. The boom proximal ends 16, 20 are pivotably connected to the longitudinal side beams 34 in a similar manner, though, laterally offset in a rearward direction. In going between raised and lowered positions, the booms pivot relative to the bunk beams and longitudinal side beams about these pins 54 The booms 12, 14 do not normally contact the longitudinal side beams 34 and bunk beams 46 except at the offset pivot joints. As shown in FIG. 2, a small space (labeled 96) is left between the booms and the beams. The booms are held at this location by the actuation assembly 26 as described below. Alternatively, the booms may be made to contact the beams, but this is not preferred because of the high loads present due to the short couple, i.e., the short distance between the point of pivot point to the point of contact.

In the raised position of FIG. 2, the boom distal end pins are slightly forward of the boom proximal end pins. The lift's raised position is thus said to be "overcenter", meaning that the load path through the booms is not vertical, but is angularly past vertical. In preferred embodiments of the present invention, the raised position is overcenter by about 2° counterclockwise from vertical. This position provides a secondary or "gravity" lock and is not meant to provide a primary method of locking.

The raising and lowering of the lift of the present invention is accomplished by the actuation assembly 26 in which one or more actuators are pivotably connected between the intermediate transverse beam 32 and the rear booms 14 (and/or rear boom cross support 44). In FIG. 2, the line labeled 94 is representative of the end connections of the actuators. In the alternative, a similar arrangement may be formed by relocating the actuators (or by adding additional actuators) to a second intermediate transverse beam (not shown) located slightly aft of the forward booms. In such embodiments, the actuators are pivotally connected to the second intermediate transverse beam and to the forward boom and/or forward cross support. Although the lift may be operated with only one actuator, it is recommended to use two or more actuators to prevent the boat from dropping uncontrollably should a single cylinder fail when the lift is not in an over-center position.

Placing the actuators between the rear booms 14 and the intermediate transverse beam 32 has a number of advantages. In the lowered lift position, the actuators are protected under the bunks and do not contact the underside of the boat. In addition, the initially loading on the cylinder is less than what is required for known diagonal actuator-to-base connection arrangements (i.e., load spike will be eliminated.) Since the highest load on the actuator determines the actuator cylinder diameter and the required fluid pressure, the elimination of load spike reduces the amount of fluid volume required by the actuation assembly. This feature allows for a more efficient actuator size, in which a smaller volume is required to do the work. A smaller volume means less fluid movement, increased speed, and less water wasted for actuators that use water. Another benefit of this arrangement is that in the lowered lift position, the orientation of the actuator includes a significant vertical directional component. This reduces the lift's minimum lowered position height, which allows the lift to be used in shallower water locations. The placement of actuators according to the present invention also results in a shorter actuator stroke. A shorter stroke and a smaller cylinder diameter advantageously lowers the actuator cost.

FIGS. 1 and 2 illustrate one configuration of an actuation assembly 26 formed in accordance with the present invention. In this configuration, the actuation assembly includes two sealed high pressure hydraulic cylinders 62. The cylinders 62 are dual-directional in the sense that they do not require watercraft weight in order to retract their rods and lower the lift. An advantage of dual-directional cylinders is that they do not introduce lake water into the piston, which results in a longer seal life. The cylinders preferably use a water soluble, environmentally friendly fluid. These types of fluid have the added benefit of not freezing during cold seasons. The high pressure hydraulic cylinders 62 are closed systems that recirculate their fluid, hence freeing the lift from having to rely on an outside source of fluid and fluid pressure to power the actuation assembly. Since the cylinders do not leak or bleed, they may be used as the primary locks in maintaining the lift at any height. The cylinders are preferably corrosion resistant, such as is provided by stainless steel cylinders or cylinders with epoxy-coated exteriors.

Figure 5:
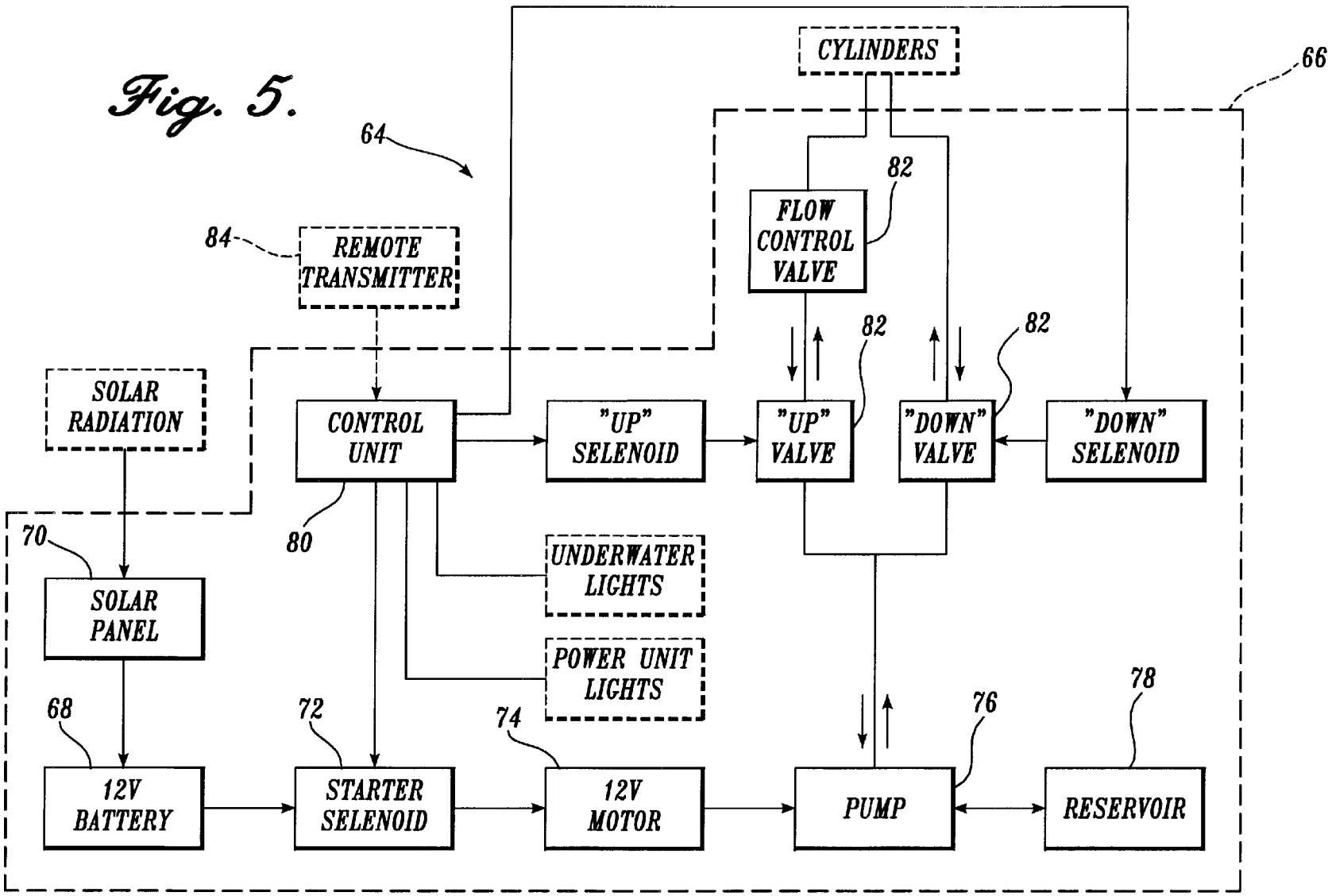
FIG. 5 is a schematic diagram of a preferred power supply source for use with either embodiment of FIGS. 1 or 3.

The high pressure hydraulic cylinders 62 are preferably powered from an independent power supply unit 64. Referring to FIG. 5, the power supply unit 64 includes a sealed housing 66 within which a battery 68, one or more solar panels 70, a starter 72, a motor 74, a pump 76, a fluid reservoir 78, and a water-resistant electronic control unit 80 are located. The solar panels charge the battery 68 which supplies power to the starter 72 and motor 74. The motor 74 drives the pump 76 which shuttles hydraulic fluid to and from the high pressure cylinders 62. The power supply unit 64 further includes various valves 82 to regulate the appropriate direction of fluid travel. The control unit 80 is preferably in communication with a remote transmitter 84, such as a keychain remote control, to allow the operator to activate the power supply unit 64 without having to get out of the boat. Optional lights 86 (FIGS. 3 and 5) are connected to the lift and/or the system to illuminate a dock and the lift during use.

Figure 4:
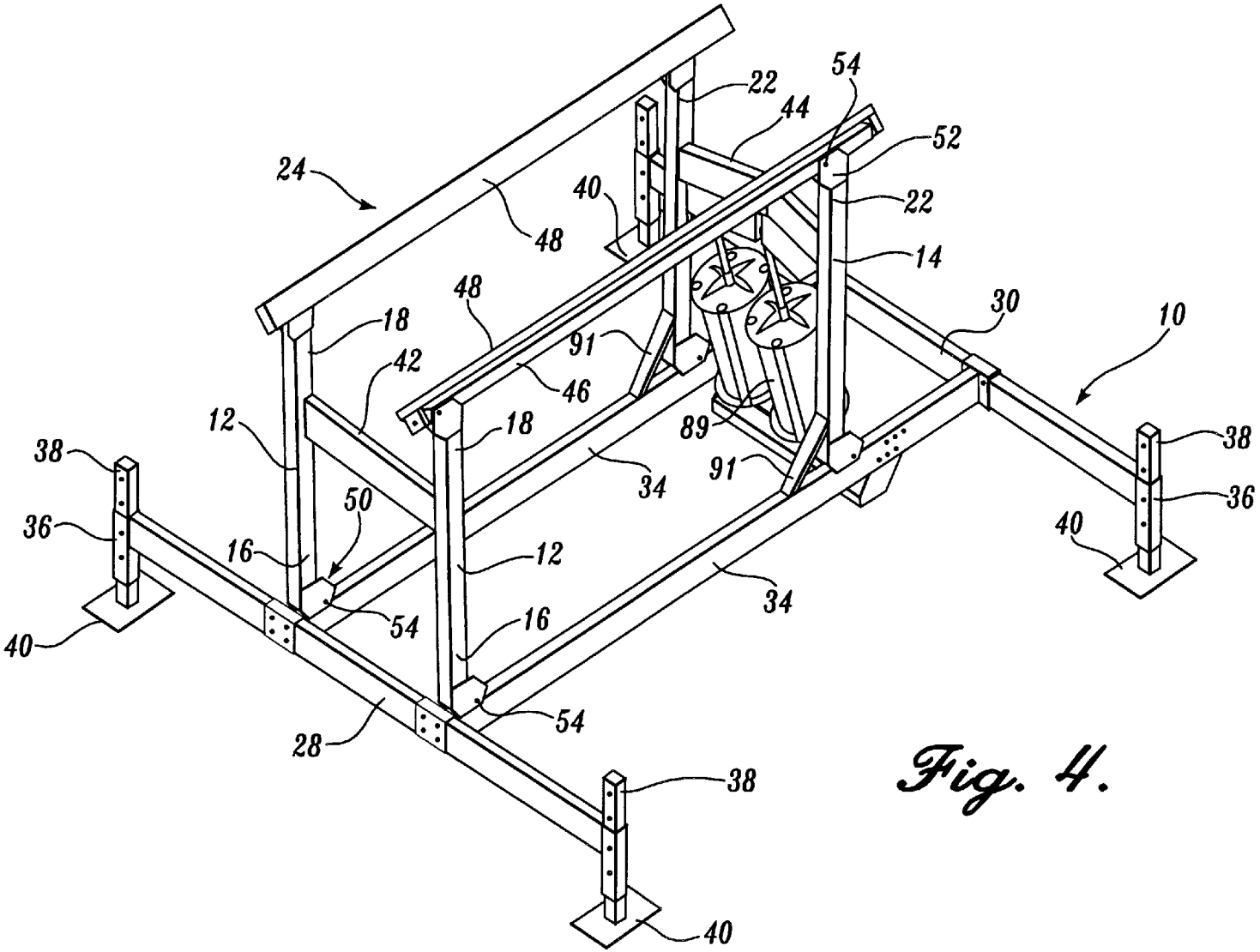
FIG. 4 is a perspective view of another alternative embodiment of a watercraft lift formed in accordance with the present invention.

FIG. 4 illustrates an alternative configuration of an actuation assembly formed in accordance with the present invention. In this configuration, the actuation assembly includes two conventional low pressure water cylinders 89 pivotably connected between the intermediate transverse beam 32 and the rear booms 14 and supplied with tap water provided from a garden hose (not shown). The low pressure water cylinders 89 may be powered from typical household water pressure.

Since low pressure water cylinders tend to be less durable, it is advantageous to provide an additional boom stop to prevent the cylinder's piston from bottoming out in both the extended and retracted positions. The boom stop shown in FIG. 4 is a canted diagonal member 91 attached to the upper surface of a longitudinal side beam at a location forward of a rear boom. In the raised lift position, the diagonal member securely and reliably braces the boom in its overcenter position. In the lifts lowered position, the bunk beams rest upon the booms and thereby prohibiting the low pressure water cylinders from reaching a fully retracted state. Alternatively, the diagonal member may be omitted and the cylinders allowed to bottom out in order to halt the further rotation of the booms.

To position a watercraft on the support platform, the lift is lowered to a position at which its raised forward end is just under the water surface. The operator then drives the craft between the platform bunks 48 until the boat's bow contacts the bunks. The actuators are extended to pivot the booms 12, 14 upward and forward about their proximal end connections. The watercraft support platform 24 follows accordingly, causing the watercraft to be lifted from the water. Full extension of the lift is achieved when the pivoting booms reach their overcenter positions. For embodiments of the lift of the present invention that incorporate boom stops, full extension of the lift is achieved when the stops are reached. To lower a craft, the cylinders are retracted causing the boom arms to pass back overcenter to their lowered position. In this manner, a craft is lowered into the water and ready to be driven off the lift.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A watercraft lift having raised and lowered positions, the lift comprising;

(a) a substantially rectangular base including longitudinal side beams and front, rear, and intermediate transverse beams connected to the longitudinal beams, the intermediate transverse beam being located between the front and rear transverse beams and at a height lower than the front and rear transverse beams;

(b) forward booms pivotably connected to the base at a location near the front transverse beam;

(c) rear booms pivotably connected to the base at a location near the intermediate transverse beam;

(d) a watercraft support platform pivotally connected to the booms; and (e) an actuating assembly comprising at least one actuator pivotally connected between the intermediate transverse beam and the rear booms, the actuator assembly being operable for rotating the booms upward and forward about their pivotable connection to the base; wherein the raised lift position is overcenter.

2. The lift formed according to claim 1, wherein the actuator is a dual-directional hydraulic cylinder.

3. The lift formed according to claim 2, wherein the hydraulic cylinder is a high pressure hydraulic cylinder capable of using a water-soluble hydraulic fluid.

4. The lift formed according to claim 1, wherein the at least one actuator includes at least one high pressure hydraulic cylinder.

5. The lift formed according to claim 4, wherein the at least one high pressure hydraulic cylinder is a water soluble hydraulic cylinder operating at a pressure in the range of about 1000 psi to about 3000 psi.

6. The lift formed according to claim 1, wherein the at least one actuator includes at least one low pressure water cylinder.

7. The lift formed according to claim 6, wherein the at least one low pressure water cylinder operates at a pressure in the range of about 40 psi to about 125 psi.

8. The lift formed according to claim 6, wherein the at least one low pressure water cylinder is two low pressure water cylinders.

9. The lift formed according to claim 1, wherein the over center position is in the range of about 1° to about 12° over center from vertical.

10. The lift formed according to claim 1, wherein the forward booms are a longer length than the rear booms such that the platform is tilted downward in the aft direction; wherein the angle of tilt decreases in going from the lowered lift position to the raised lift position.

11. The lift formed according to claim 10, wherein the distance between the pivotable connection of the forward booms to the base to the pivotable connection of the rear booms to base is greater than the distance between the pivotable connection of the forward booms to the watercraft support platform to the pivotable connection of the rear booms to the watercraft support platform.

12. The lift formed according to claim 1, wherein the at least one actuators are two high pressure hydraulic cylinders.

13. The lift formed according to claim 1, wherein the at least one actuators are four high pressure hydraulic cylinders.

14. A lift for watercraft comprising;

(a) a substantially rectangular base including longitudinal side beams and front, rear, and intermediate transverse beams connected to the longitudinal beams, the intermediate transverse beam being located between the front and rear transverse beams and at a height lower than the front and rear transverse beams;

(b) forward booms pivotably connected to the base at a location near the front transverse beam;

(c) rear booms pivotably connected to the base at a location near the intermediate transverse beam;

(d) a watercraft support platform pivotally connected to the booms;

(e) an actuating assembly comprising at least one high pressure hydraulic cylinder pivotally connected between the intermediate transverse beam and the rear booms; and (f) an independent power supply unit including a housing, a battery, a motor, a pump, and a control unit; the battery, motor, pump, and control unit being positioned within the housing and being capable of activating the at least one high pressure hydraulic cylinder.

15. The lift formed according to claim 14, wherein the power supply unit further includes solar panel connected to the battery and located within the housing.

16. The lift formed according to claim 14, further comprising a remote control transmitting device in communication with the control unit, whereby the remote control transmitting device is capable of activating the control unit and the at least one high pressure hydraulic cylinder.

17. The lift formed according to claim 16, further comprising at least one underwater light in communication with the remote control transmitting device, whereby the remote control transmitting device is capable of activating the at least one underwater light.

18. The lift formed according to claim 17, wherein the at least one underwater light is positioned on the power supply unit.

19. The lift formed according to claim 14, wherein the rear booms include a cross member and the at least one high pressure hydraulic cylinder is pivotably connected to the rear booms at the cross member.

20. A watercraft lift having raised and lowered positions, the lift comprising;

(a) a base including longitudinal side beams and front, rear, and intermediate transverse beams connected to the longitudinal beams, the intermediate transverse beam being located between the front and rear transverse beams;

(b) forward booms pivotably connected to the base at a location near the front transverse beam; the forward booms being of a first length;

(c) rear booms pivotably connected to the base at a location near the intermediate transverse beam; the rear booms being of a second length, the second length being less than the forward boom first length;

(d) a watercraft support platform pivotally connected to the forward and rear booms; and (e) an actuating assembly comprising at least one actuator pivotally connected between the intermediate transverse beam and the rear booms.

21. The lift formed according to claim 20, wherein the raised lift position is overcenter.

22. The lift formed according to claim 21, wherein the over center position is in the range of about 1° to about 12° over center from vertical.

23. The lift formed according to claim 20, wherein the actuator assembly includes at least one dual-directional high pressure hydraulic fluid cylinder.

24. The lift formed according to claim 20, wherein the at least one actuator includes at least one low pressure water cylinder.

25. The lift formed according to claim 20, wherein the distance between the pivotable connection of the forward booms to the base to the pivotable connection of the rear booms to the base is greater than the distance between the pivotable connection of the forward booms to the watercraft support platform to the pivotable connection of the rear booms to the watercraft support platform.

26. The lift formed according to claim 20, wherein the watercraft support platform is tilted downward in the aft direction, the angle of tilt decreasing in going from the lowered lift position to the raised lift position.

27. The lift formed according to claim 20, wherein the base includes upright support posts connected to the front and rear transverse beams for attaching a canopy structure thereto.

28. The lift formed according to claim 20, wherein the intermediate transverse beam is at a height that is lower than at least one of the heights of the front and rear transverse beams.

29. The lift formed according to claim 20, further including an independent power supply unit including a housing, a battery, a motor, a pump, and a control unit; the battery, motor, pump, and control unit being positioned within the housing and being capable of activating the actuating assembly.

30. The lift formed according to claim 29, wherein the power supply unit further includes solar panel connected to the battery and connected to the housing.

31. The lift formed according to claim 20, wherein the rear booms include a cross member and the actuating assembly is pivotably connected to the rear booms at the cross member.

* * * * *